US011963574B2

(12) United States Patent
Megrabyan et al.

(10) Patent No.: US 11,963,574 B2
(45) Date of Patent: Apr. 23, 2024

(54) SOLE STRUCTURE FOR ARTICLE OF FOOTWEAR

(71) Applicant: NIKE, Inc., Beaverton, OR (US)

(72) Inventors: Mesrop Megrabyan, Portland, OR (US); Nathan M. VanHook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 58 days.

(21) Appl. No.: 17/496,730

(22) Filed: Oct. 7, 2021

(65) Prior Publication Data

US 2022/0110405 A1 Apr. 14, 2022

Related U.S. Application Data

(60) Provisional application No. 63/090,120, filed on Oct. 9, 2020.

(51) Int. Cl.

| | |
|---|---|
| ***A43B 13/12*** | (2006.01) |
| ***A43B 13/14*** | (2006.01) |
| ***A43B 13/18*** | (2006.01) |
| ***A43B 13/22*** | (2006.01) |

(52) U.S. Cl.

CPC ..... *A43B 13/125* (2013.01); *A43B 13/127* (2013.01); *A43B 13/148* (2013.01); *A43B 13/181* (2013.01); *A43B 13/223* (2013.01)

(58) Field of Classification Search

CPC ... A43B 13/125; A43B 13/148; A43B 13/223; A43B 13/12; A43B 13/127; A43B 13/181; A43B 13/41; A43B 7/1415

USPC ..... 36/107, 108

See application file for complete search history.

(56) References Cited

U.S. PATENT DOCUMENTS

| | | | | |
|---|---|---|---|---|
| 1,387,411 A * | 8/1921 | Kolkebeck | ..... | A43B 7/142 36/76 R |
| 5,528,842 A * | 6/1996 | Ricci | ..... | A43B 21/30 36/38 |
| 6,416,610 B1 * | 7/2002 | Matis | ..... | A43B 13/12 264/273 |

(Continued)

FOREIGN PATENT DOCUMENTS

WO 2020018473 A1 1/2020

OTHER PUBLICATIONS

International Search Report in PCT/US2021/054231, dated Feb. 2, 2022 (5 pages).

*Primary Examiner* — Khoa D Huynh
*Assistant Examiner* — Haley A Smith
(74) *Attorney, Agent, or Firm* — Bookoff McAndrews, PLLC

(57) ABSTRACT

A sole structure including a midsole, an outsole, and a plate disposed between the plate and the outsole. The plate includes a first portion having an arcuate shape extending through a forefoot region and a mid-foot region, and a planar second portion connected to the first portion along a joint and extending in a first plane at an oblique angle from the joint. The plate includes a first channel extending from a first end of the plate along the first portion and in a direction toward the second portion. A second channel extends from a second end of the plate along the second portion and in a direction toward the first portion. The first channel separates the plate into a first pair of tabs formed at the first end and the second channel separates the plate into a second pair of channels formed at the second end.

19 Claims, 9 Drawing Sheets

(56) References Cited

U.S. PATENT DOCUMENTS

| | | | | |
|---|---|---|---|---|
| 9,615,625 | B1 * | 4/2017 | Huard | A43B 13/141 |
| 9,936,765 | B2 * | 4/2018 | Sato | A43B 13/186 |
| 2003/0172548 | A1 | 9/2003 | Fuerst | |
| 2017/0035143 | A1 * | 2/2017 | Sato | A43B 7/148 |
| 2017/0079373 | A1 * | 3/2017 | Huard | A43B 7/144 |
| 2017/0095033 | A1 * | 4/2017 | Farina | A43B 7/18 |
| 2017/0196305 | A1 * | 7/2017 | Barnes | A43B 5/06 |
| 2018/0199675 | A1 | 7/2018 | Cook et al. | |
| 2020/0281311 | A1 | 9/2020 | Connell et al. | |

* cited by examiner

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/090,120, filed on Oct. 9, 2020. The disclosure of this prior application is considered part of the disclosure of this application and is hereby incorporated by reference in its entirety.

FIELD

The present disclosure relates generally to a sole structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The midsole may include a pressurized fluid-filled chamber that compresses resiliently under an applied load to cushion the foot by attenuating ground-reaction forces. The outsole provides abrasion-resistance and traction with the ground surface and may be formed from rubber or other materials that impart durability and wear-resistance, as well as enhance traction with the ground surface.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
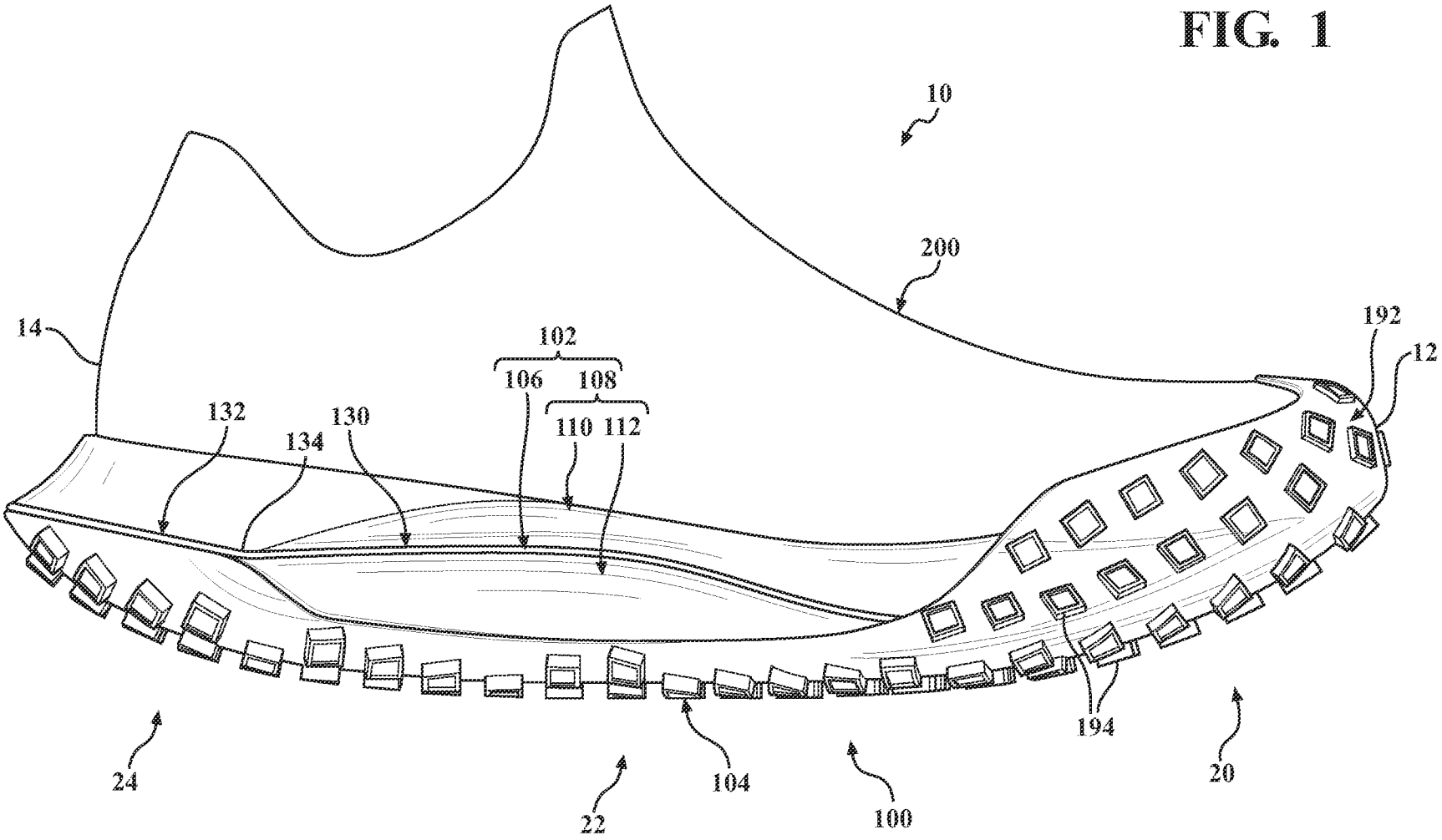
FIG. 1 is a lateral side elevation view of an article of footwear including an example of a sole structure according to the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear includes a plate extending from a first end disposed at an anterior end of the sole structure to a second end disposed at a posterior end of the sole structure, the plate including a first channel formed in the first end and extending in a first direction toward the second end and a second channel formed in the second end and extending in a second direction toward the first end.

The sole structure may include one or more of the following optional features. For example, the first channel and the second channel may both be elongate and/or may include the same shape. Additionally or alternatively, the first channel may extend at a first oblique angle relative to a longitudinal axis of the plate and the second channel may extend at a second oblique angle relative to the longitudinal axis of the plate. A longitudinal axis of the first channel may be convergent with a longitudinal axis of the second channel.

The plate may include a ramped portion extending from a heel region of the plate to the posterior end and extending in a direction away from a ground contacting surface of the sole structure, the second channel being formed in the ramped portion.

In one configuration, the first channel may be longer than the second channel and/or at least one of the first channel and the second channel may include a parallelogram shape.

The plate may be disposed between a midsole and an outsole and may have a greater hardness than the midsole.

An article of footwear may incorporate the plate described above.

In another configuration, a plate for an article of footwear includes a main body having a first portion including an arcuate shape and a planar second portion extending in a first plane at an oblique angle from the first portion. A first channel extends from a first end of the main body, along the first portion, and in a direction toward the second portion. A second channel extends from a second end of the main body, along the second portion, and in a direction toward the first portion.

The sole structure may include one or more of the following optional features. For example, the first channel may extend from the first end to a terminal end of the first channel along a first longitudinal axis. In this configuration, the first longitudinal axis may be convergent with a longitudinal axis of the plate. Additionally, the first portion may include a taper that extends from the first portion and terminates at the terminal end of the first channel. The taper may be aligned with the first channel and may include a similar width as the first channel, the width being measured in a direction substantially transverse to a longitudinal axis of the plate.

The second channel may extend from the second end to a terminal end of the second channel along a second longitudinal axis. The second longitudinal axis may be divergent from a longitudinal axis of the plate. The second portion may include a taper extending from the first portion and terminating at the terminal end of the second channel. The taper may be aligned with the second channel and may include a similar width as the second channel, the width being measured in a direction substantially transverse to a longitudinal axis of the plate.

In one configuration, the first channel may be longer than the second channel. Additionally or alternatively, at least one of the first channel and the second channel may include a polygonal shape. Further, the first channel and the second channel may both be elongate and/or the first channel and the second channel may include the same shape.

The first channel may separate the first end of the plate into a first pair of tabs. Additionally or alternatively, the second channel may separate the second end of the plate into a second pair of tabs.

The details of one or more implementations of the disclosure are set forth in the accompanying drawings and the description below. Other aspects, features, and advantages will be apparent from the description, the drawings, and the claims.

Referring to FIG. 1, an article of footwear 10 includes a sole structure 100 and an upper 200 attached to the sole structure 100. The footwear 10 may further include an anterior end 12 associated with a forward-most point of the footwear 10, and a posterior end 14 corresponding to a rearward-most point of the footwear 10. A longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 corresponds to the metatarsophalangeal (MTP) joint of the foot and may be subdivided into a toe portion $\mathbf{20}_T$ corresponding with phalanges and a ball portion $\mathbf{20}_B$ associated with metatarsal bones of a foot. The mid-foot region 22 may correspond with an arch area of the foot, and the heel region 24 may correspond with rear portions of the foot, including the calcaneus bone.

Figure 2:
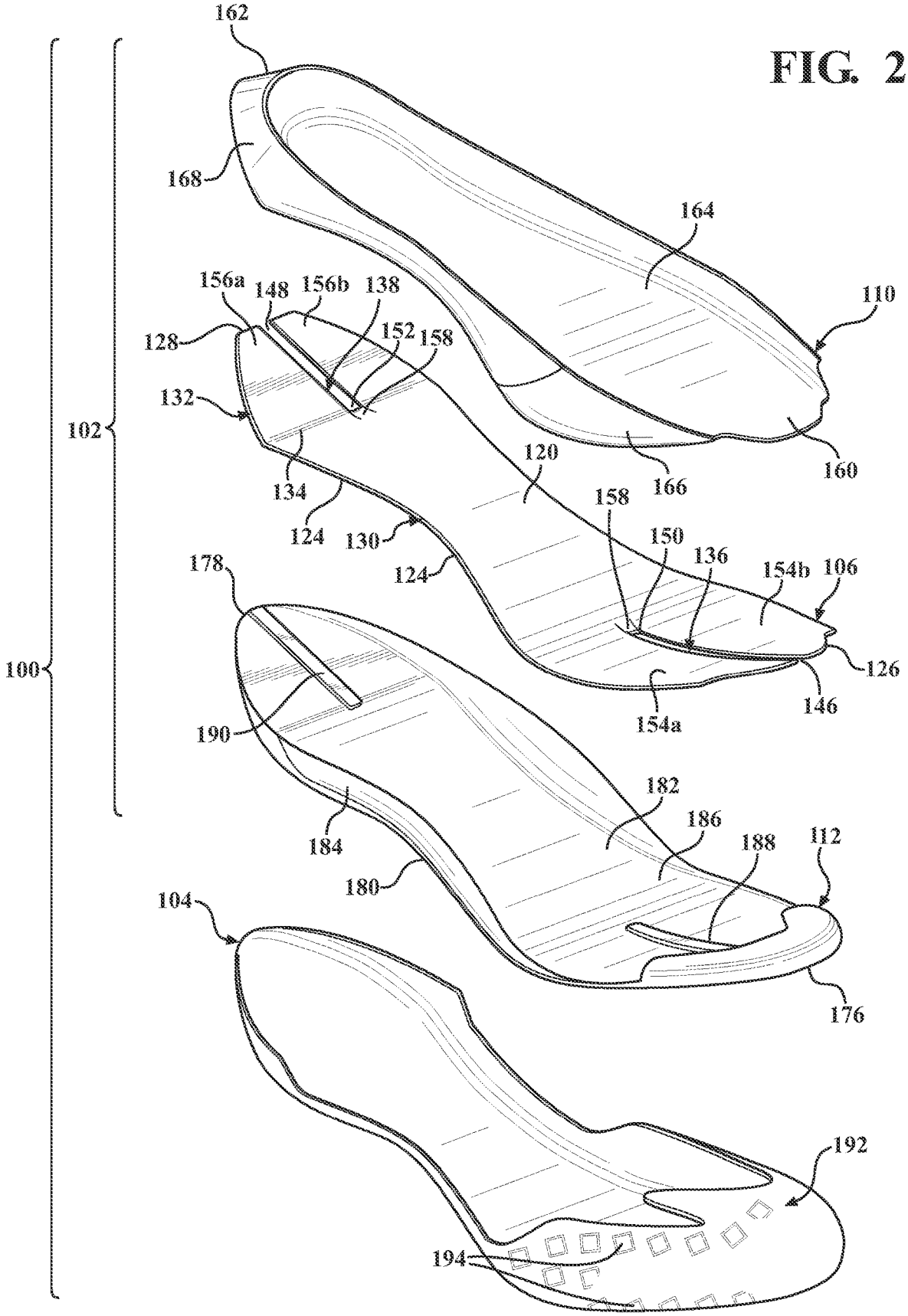
FIG. 2 is a top-front exploded perspective view of the sole structure of FIG. 1.

With reference to FIGS. 1 and 2, the sole structure 100 includes a midsole 102 configured to provide cushioning and responsiveness characteristics to the sole structure 100, and an outsole 104 configured to provide a ground-engaging surface of the article of footwear 10. Unlike conventional sole structures including a unitary midsole, the midsole 102 of the present example is formed compositely and includes multiple subcomponents. For example, the midsole 102 includes a plate 106 enclosed within a cushioning element 108 of the midsole 102. Particularly, the cushioning element 108 may include an upper cushioning member 110 and a lower cushioning member 112 configured to position and retain the plate 106 within the midsole 102. The outsole 104 is formed as a unitary member that at least partially encapsulates a lower portion of the midsole 102. The subcomponents 104, 106, 110, 112 of the sole structure 100 are assembled and secured to each other using various methods of bonding, including adhesively bonding and melding, for example.

Figure 6:
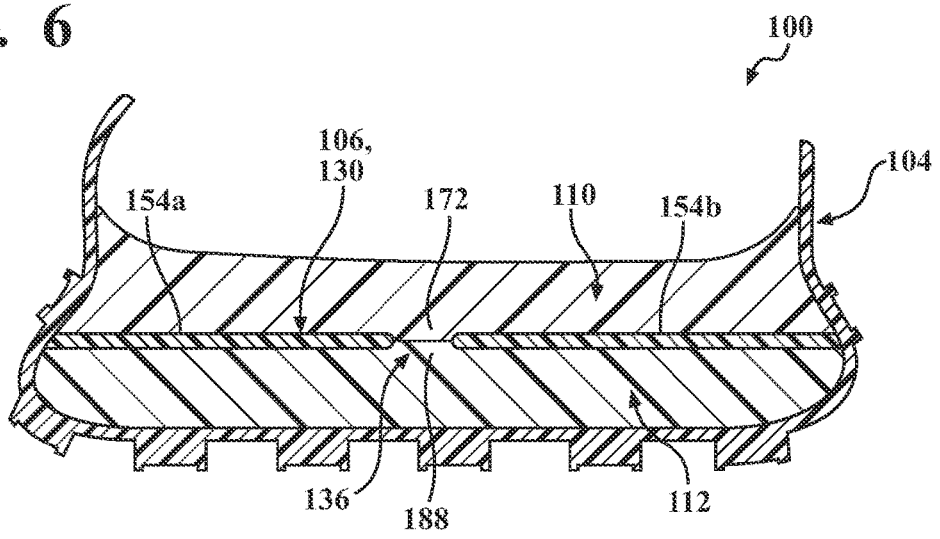
FIG. 6 is a cross-sectional view of the sole structure of FIG. 1, taken along Line 6-6 in FIG. 4.
Figure 7:
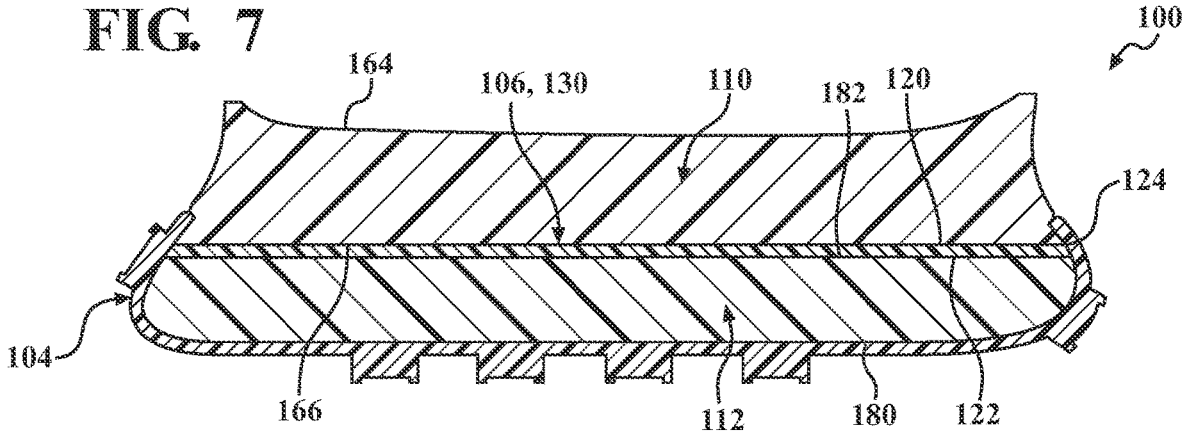
FIG. 7 is a cross-sectional view of the sole structure of FIG. 1, taken along Line 7-7 in FIG. 4.
Figure 8:
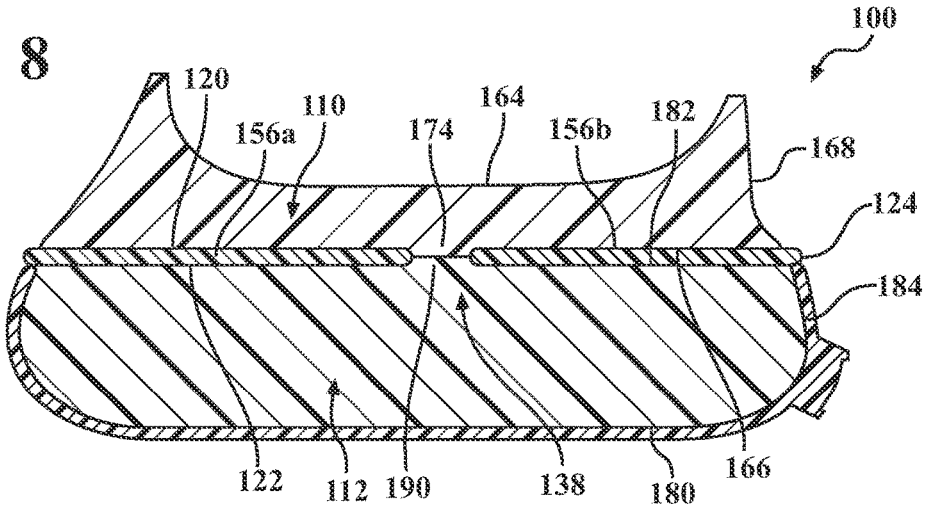
FIG. 8 is a cross-sectional view of the sole structure of FIG. 1, taken along Line 8-8 in FIG. 4.
Figure 9:
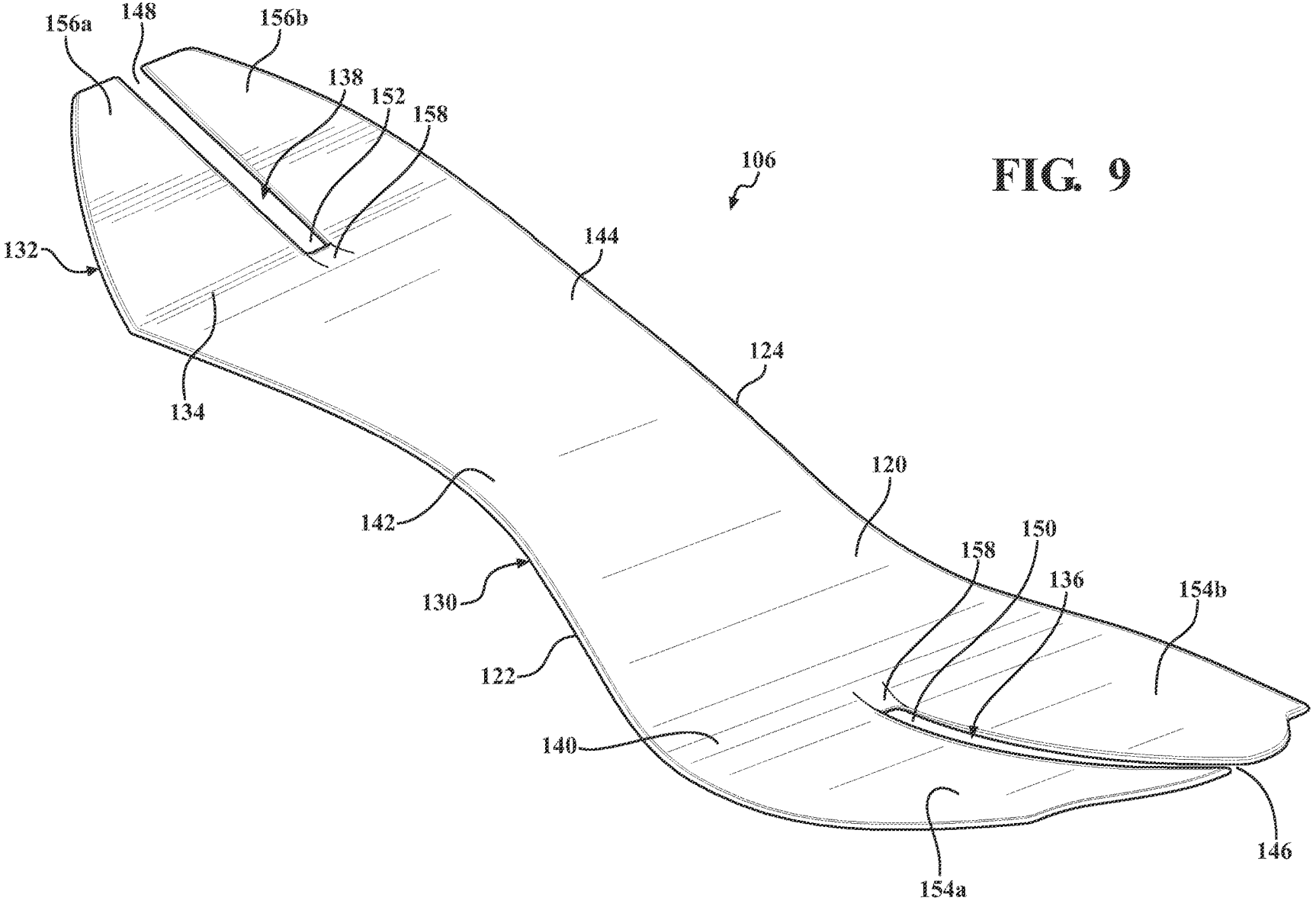
FIG. 9 is a perspective view of an example of a plate of the sole structure of FIG. 1.

With reference to FIGS. 2-11, the plate 106 includes a top side 120, a bottom side 122 formed on an opposite side of the plate 106 than the top side 120, and a peripheral edge 124 extending from the top side 120 to the bottom side 122 and defining a peripheral profile of the plate 106. A distance from the top side 120 to the bottom side 122 defines a thickness of the plate 106, as discussed in greater detail below. The top side 120 is configured to face the upper 200 and interfaces with the upper cushioning member 110 of the midsole 102 while the bottom side 122 of the plate 106 is configured to face away from the upper 200 and interfaces with the lower cushioning member 112. Referring to FIGS. 1 and 8, portions of the peripheral edge 124 may be exposed between the upper cushioning member 110 and the lower cushioning member 112 along each of the medial side 16 and the lateral side 18 of the sole structure 100 such that the peripheral edge 124 defines a portion of an outer periphery of the sole structure 100.

The plate 106 of the sole structure 100 may be referred to as a "full-length" plate 106 that extends along substantially the entire length of the sole structure 100. For example, the plate 106 extends along the length of the sole structure 100 through each of the forefoot region 20, the mid-foot region 22, and the heel region 24. In the illustrated example, the plate 106 extends from a first end 126 adjacent to the anterior end 12 to a second end 128 adjacent to the posterior end 14. More specifically, the first end 126 of the plate terminates within the toe portion $\mathbf{20}_T$ of the forefoot region 20 while the second end 128 extends entirely through the heel region 24. Thus, the second end 128 of the plate 106 is exposed at the posterior end 14 between the upper cushioning member 110 and the lower cushioning member 112.

The plate 106 may be described as including an arcuate first portion defining a body 130 of the plate 106 extending from the first end 126 and a ramped second portion defining a tail 132 extending from the body 130 to the second end 128. The body 130 and the tail 132 are joined together along a laterally extending (i.e., transverse to the longitudinal axis $A_{10}$) joint 134 in the heel region 24. As discussed in greater detail below, the body 130 may be described as having a contoured or arcuate profile along the longitudinal direction and includes a first channel 136 extending from the first end 126 towards the tail 132. Conversely, the tail 132 has a straight profile extending along the longitudinal direction and includes a second channel 138 extending from the second end 128 towards the body 130.

Figure 5:
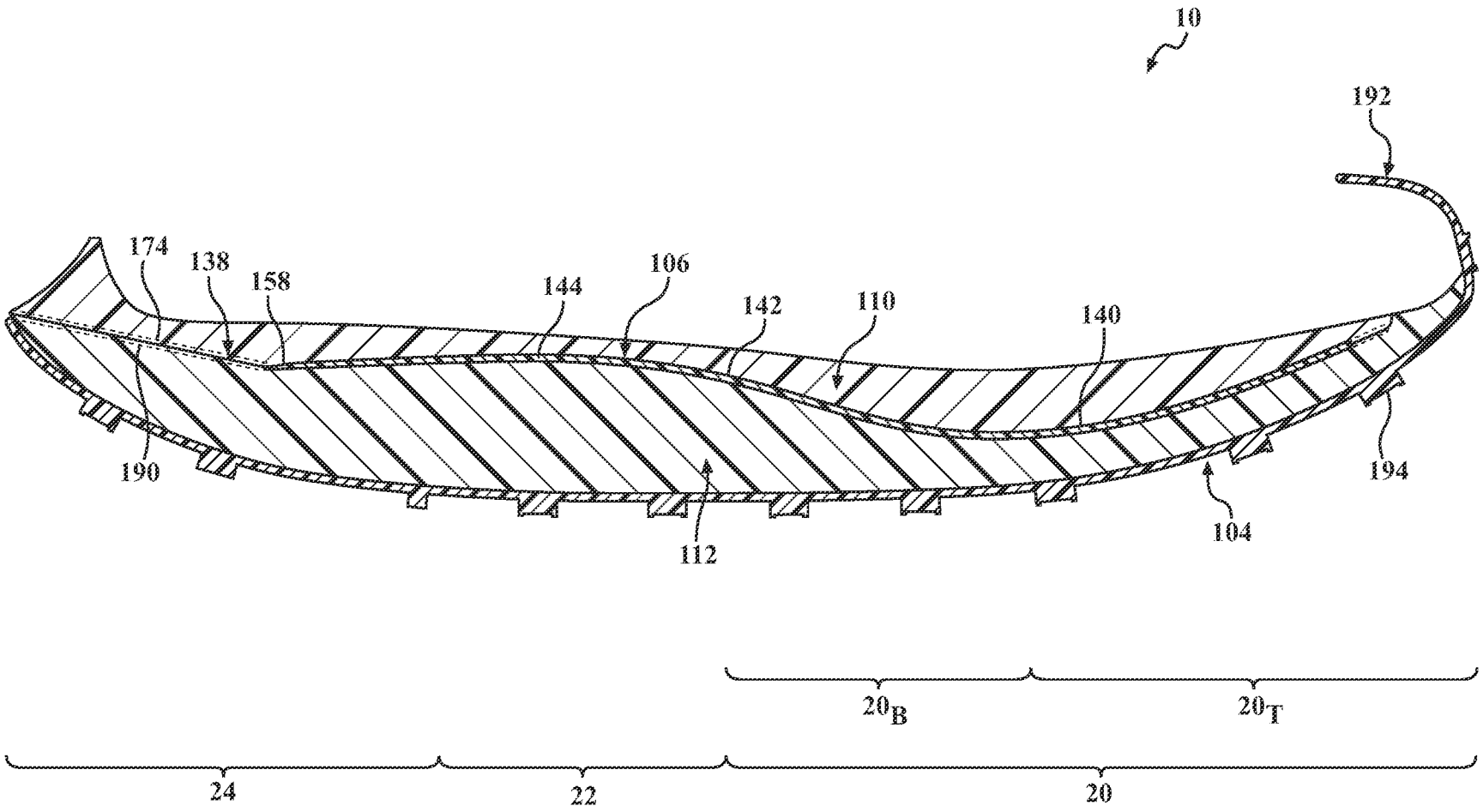
FIG. 5 is a cross-sectional view of the sole structure of FIG. 1, taken along Line 5-5 in FIG. 4.

Referring to FIGS. 5-7 and 9-11, the body 130 of the plate 106 includes a compound curvature extending along the longitudinal direction (FIGS. 5 and 11) and is substantially straight along the lateral direction (FIGS. 6 and 7). As shown, the body 130 includes a concave portion 140 extending from the first end 126 and along the forefoot region 20, a convex portion 142 extending from the concave portion 140 and through the mid-foot region 22, and a substantially straight portion 144 extending from the convex portion 142 to the joint 134 in the heel region 24. For clarity, the terms "concave" and "convex" are used with reference to the profile of the top side 120 of the plate 106. Accordingly, it will be appreciated that the corresponding portions of the plate 106 formed by the bottom side 122 may be respectively referred to as "convex" and "concave."

Figure 11:
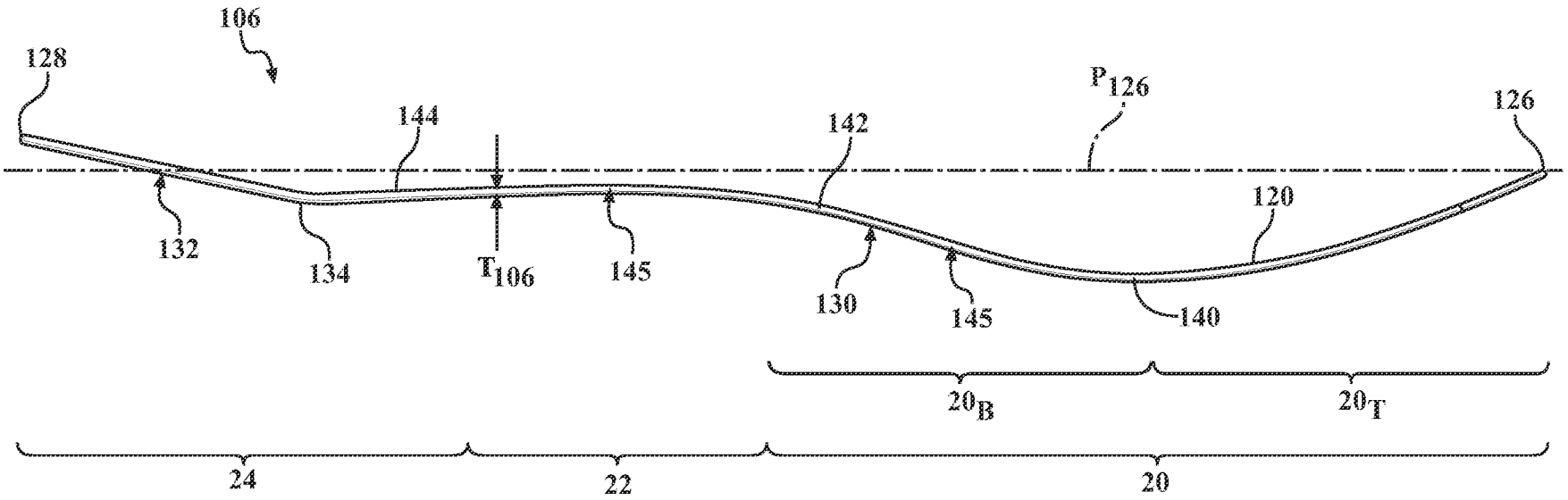
FIG. 11 is a side elevation view of the plate of FIG. 9.

As shown in FIG. 11, the concave portion 140 of the body 130 extends continuously from the first end 126 to a first transition 145 formed approximately between the forefoot region 20 and the midfoot region 22. Thus, the location of the concave portion 140 corresponds to a portion of the foot including the phalanges and the metatarsal bones of the foot, and includes a trough extending along an MTP axis $A_{MTP}$ associated with the MTP joint of the foot. The concave portion 140 is tangent with the convex portion 142 at the first transition 145 such that the curvature of the body 130 is substantially continuous through the forefoot region 20 and the mid-foot region 22. The convex portion 142 extends from the first transition 145 between the forefoot region 20 and the mid-foot region 22 to a second transition 145 between the mid-foot region 22 and the heel region 24. Here, the straight portion 144 extends from the second transition 145 to the joint 134 formed between the body 130 and the tail 132. The straight portion 144 of the body 130 is tangent with the convex portion 142 at the second transition 145 such that the curvature of the top side 120 of the plate 106 transitions from convex to concave.

The tail 132 of the plate 106 is joined to the straight portion 144 of the body 130 along the joint 134 and extends from the joint 134 to the second end 128 of the plate 106. As shown, the tail 132 is substantially straight and extends from the joint 134 at an oblique angle relative to the straight portion 144 of the body 130. Thus, unlike the adjacent portions 140, 142, 144 of the body 130, which are tangential and continuous with each other, the joint 134 forms a definite transition between the body 130 and the tail 132. In the illustrated example, the tail 132 is straight along each of the longitudinal and lateral directions such that the tail 132 is substantially planar. As shown, the joint 134 is located at a point of the plate 106 corresponding to the calcaneus bone of the foot such that the body 130 and the tail 132 flex around the calcaneus bone along the joint 134.

With continued reference to FIG. 11, the profile of the plate 106 may be described relative to a horizontal reference plane $P_{126}$ that extends through the first end 126 of the plate 106 when the plate 106 is incorporated within the sole structure 100 and the sole structure 100 is in a resting state relative to the ground surface. As shown, the entire body 130 of the plate 106 is positioned beneath the first end 126 of the plate 106. Here, the convex portion 142 of the body 130 converges with the reference plane $P_{126}$ of the first end 126 along the direction from the first transition 145 to the second transition 145. The straight portion 144 of the body 130 then diverges from the reference plane $P_{126}$ along the direction from the second transition 145 to the joint 134 such that the joint 134 is disposed below the reference plane $P_{126}$ associated with the first end 126. From the joint 134, the tail 132 extends upwardly towards and intersects the reference plane $P_{126}$ such that the second end 128 of the plate 106 is disposed above the reference plane $P_{126}$ and the first end 126. In other words, a first portion of the tail 132 is disposed below the first end 126 of the plate 106 and a second portion of the tail 132 extends above the first end 126 of the plate 106.

Figure 4:
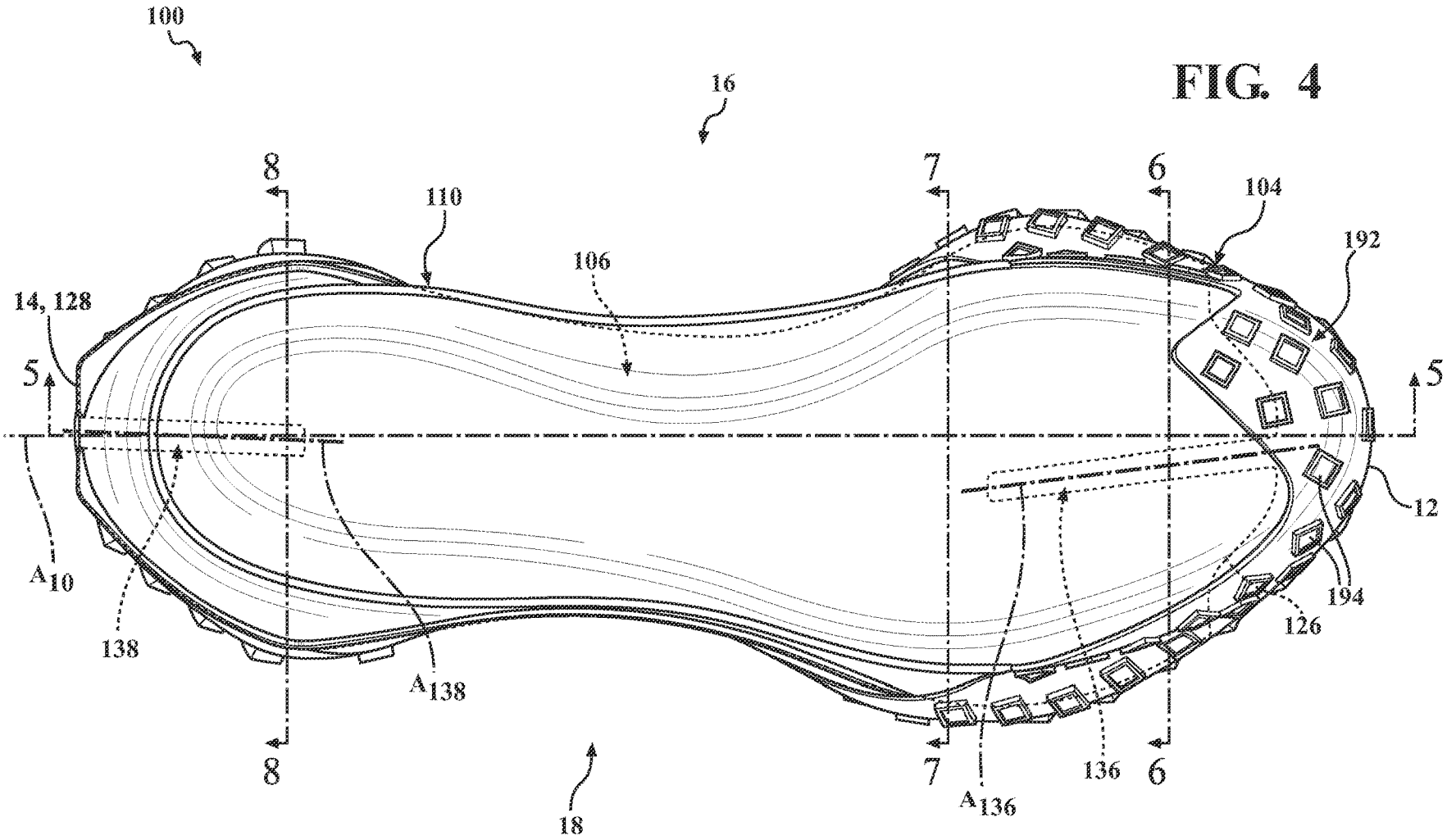
FIG. 4 is a top plan view of the sole structure of FIG. 1.
Figure 10:
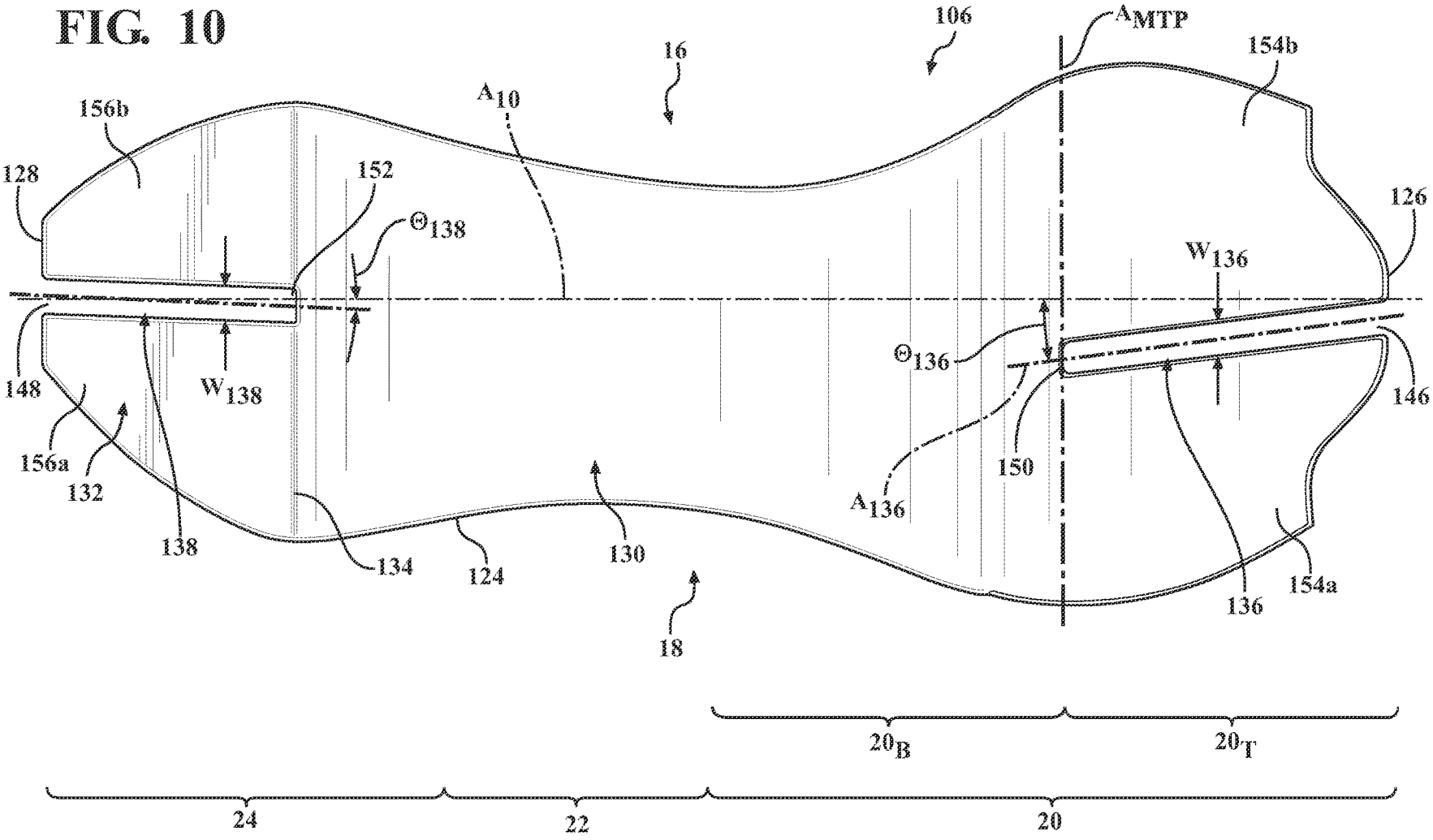
FIG. 10 is a top plan view of the plate of FIG. 9.

As shown in FIG. 10, each end 126, 128 of the plate 106 may have an offset or truncated profile. Here, the peripheral edge 124 of the plate 106 extends along a substantially continuous arcuate profile along each of the medial side 16 and the lateral side 18 corresponding to a profile of the foot. However, the peripheral edge 124 defines an offset curvature along the first end 126 such that the portion of the peripheral edge 124 defining the first end 126 is configured to be offset inwardly from an outer periphery of the sole structure 100, as indicated in FIG. 4. Conversely, the second end 128 of the plate 106 is coincident with the outer periphery of the sole structure 100, but has a truncated profile formed by a straight portion of the peripheral edge 124 extending in the lateral direction across the plate 106.

With continued reference to FIG. 10, the first channel 136 and the second channel 138 extend along the longitudinal direction from opposite ends 126, 128 of the plate 106. Each channel 136, 138 is formed entirely through the thickness $T_{106}$ of the plate 106 and extends from an open end 146, 148 formed in the peripheral edge 124 to a distal terminal end 150, 152 formed within the plate 106. Each channel 136, 138 may have an elongate profile extending along a corresponding longitudinal axis $A_{136}$, $A_{138}$ from the open end 146, 148 to the terminal end 150, 152. In the illustrated example, each channel 136, 138 has a pair of straight sides extending between the open end 146, 148 and the respective terminal end 150, 152. As shown, the sides of the channels 136, 138 are parallel such that each channel 136, 138 has a constant width $W_{136}$, $W_{138}$ along the longitudinal direction. The terminal end 150, 152 is straight such that the outer perimeter of each channel 136, 138 has shape of a parallelogram. Optionally, the terminal ends 150, 152 of each channel 136, 138 may be perpendicular to the longitudinal axis $A_{10}$ and parallel to each other.

The first channel 136 extends along the longitudinal axis $A_{136}$ from the open end 146 at the first end 126 of the plate 106 to the terminal end 150 substantially located at the MTP axis $A_{MTP}$ between the toe portion $\mathbf{20}_T$ and the ball portion $\mathbf{20}_B$. As shown in FIG. 4, the first channel 136 is oriented at a first oblique angle $\theta_{136}$ relative to the longitudinal axis $A_{10}$ of the article of footwear 10 such that the open end 146 is closer to the medial side 16 than the terminal end 150. The second channel 138 extends along the longitudinal axis $A_{138}$ from the open end 146 at the second end 128 of the plate 106 to the terminal end 152 at the joint 134 in the heel region 24. As shown in FIG. 4, the second channel 138 is oriented at a second oblique angle $\theta_{138}$ relative to the longitudinal axis $A_{10}$ of the article of footwear 10 such that the open end 146 is closer to the medial side 16 than the terminal end 150. Thus, the second channel 138 extends at a transverse angle towards the first channel 136. However, while the channels 136, 138 extend transverse to each other, the terminal ends 150, 152 of each of the channels 136, 138 are parallel to each other and are substantially perpendicular to the longitudinal axis $A_{10}$.

Referring still to FIG. 10, each of the channels 136, 138 separates the plate 106 into a corresponding pair of tabs 154*a*, 154*b*, 156*a*, 156*b*. For example, the first channel 136 separates the concave portion 140 of the body 130 into a medial tab 154*a* and a lateral tab 154*b* in the toe portion $\mathbf{20}_T$. Likewise, the second channel 138 separates the tail 132 of the plate 106 into a medial tab 156*a* and a lateral tab 156*b*. The medial tabs 154*a*, 156*a* are configure to flex independently of the lateral tabs 154*b*, 156*b* at each of the first end 126 and the second end 128 of the plate 106, providing the plate 106 with improved dexterity in a lateral direction while cooperating to provide combined stiffness and support along the longitudinal direction. Optionally, the plate 106 may include flexures 158 formed adjacent to each terminal end 150, 152 between each pair of tabs 154*a*, 154*b*, 156*a*, 156*b*. Here, each flexure 158 is formed by a tapered portion of the plate 106 extending parallel to the respective longitudinal axis $A_{136}$, $A_{138}$ and terminating at the terminal end 152.

The plate 106 includes one or more materials providing relatively high strength and stiffness, such as polymeric materials and/or composite materials. In some examples, the plate 106 is a composite material manufactured using fiber sheets or textiles, including pre-impregnated (i.e., "prepreg") fiber sheets or textiles. Alternatively or additionally, the plate 106 may be manufactured by strands including multiple filaments of one or more types of fiber (e.g., fiber tows) by affixing the fiber tows to a substrate or to each other to produce a plate having the strands of fibers arranged predominately at predetermined angles or in predetermined positions. When using strands of fibers, the types of fibers included in the strand can include synthetic polymer fibers which can be melted and re-solidified to consolidate the other fibers present in the strand and, optionally, other components such as stitching thread or a substrate or both. Alternatively or additionally, the fibers of the strand and, optionally the other components such as stitching thread or a substrate or both, can be consolidated by applying a resin after affixing the strands of fibers to the substrate and/or to each other.

In some configurations, plate 106 may be formed from one or more layers of tows of fibers and/or layers of fibers including at least one of carbon fibers, boron fibers, glass fibers, and polymeric fibers. In a particular configuration, the fibers include carbon fibers, or glass fibers, or a combination of both carbon fibers and glass fibers. The tows of fibers may be affixed to a substrate. The tows of fibers may be affixed by stitching or using an adhesive. Additionally or alternatively, the tows of fibers and/or layers of fibers may be consolidated with a thermoset polymer and/or a thermoplastic polymer. Accordingly, the plate 106 may have a tensile strength or flexural strength in a transverse direction substantially perpendicular to the longitudinal axis of the article of footwear (i.e., the axis extending from the anterior end 12 to the posterior end 14). The stiffness of the plate 106 may be selected for a particular wearer based on the wearer's tendon flexibility, calf muscle strength, and/or metatarsophalangeal (MTP) joint flexibility. Moreover, the stiffness of the plate 106 may also be tailored based upon a running motion of the athlete. In other configurations, the plate 106 is formed from one or more layers/plies of unidirectional tape. In some examples, each layer in the stack includes a different orientation than the layer disposed underneath. The plate may be formed from unidirectional tape including at least one of carbon fibers, boron fibers, glass fibers, and polymeric fibers. In some examples, the one or more materials forming the plate 106 result in the plate 106 having a Young's modulus of at least 70 gigapascals (GPa).

In some implementations, the plate 106 includes a substantially uniform thickness $T_{106}$. In some examples, the thickness $T_{106}$ of the plate 106 ranges from about 0.6 millimeters (mm) to about 3.0 mm. In one example, the thickness $T_{106}$ of the plate 106 is substantially equal to one 1.0 mm. In other implementations, the thickness $T_{106}$ of the plate 106 is non-uniform such that the plate 106 may have a greater thickness $T_{106}$ in one region 20, 22, 24 of the sole structure 100 than the thicknesses $T_{202}$ in the other regions 20, 22, 24.

As provided above, the plate 106 is located and retained within a cushioning element 108 of the midsole 102 between an upper cushioning member 110 and a lower cushioning member 112. Each of the upper cushioning member 110 and the lower cushioning member 112 may be include an elastomeric material having a lower hardness than the plate 106. Thus, the plate 106 provides rigidity along the length of the midsole 102 and the cushioning element 108 provides resiliency and cushioning.

Figure 3:
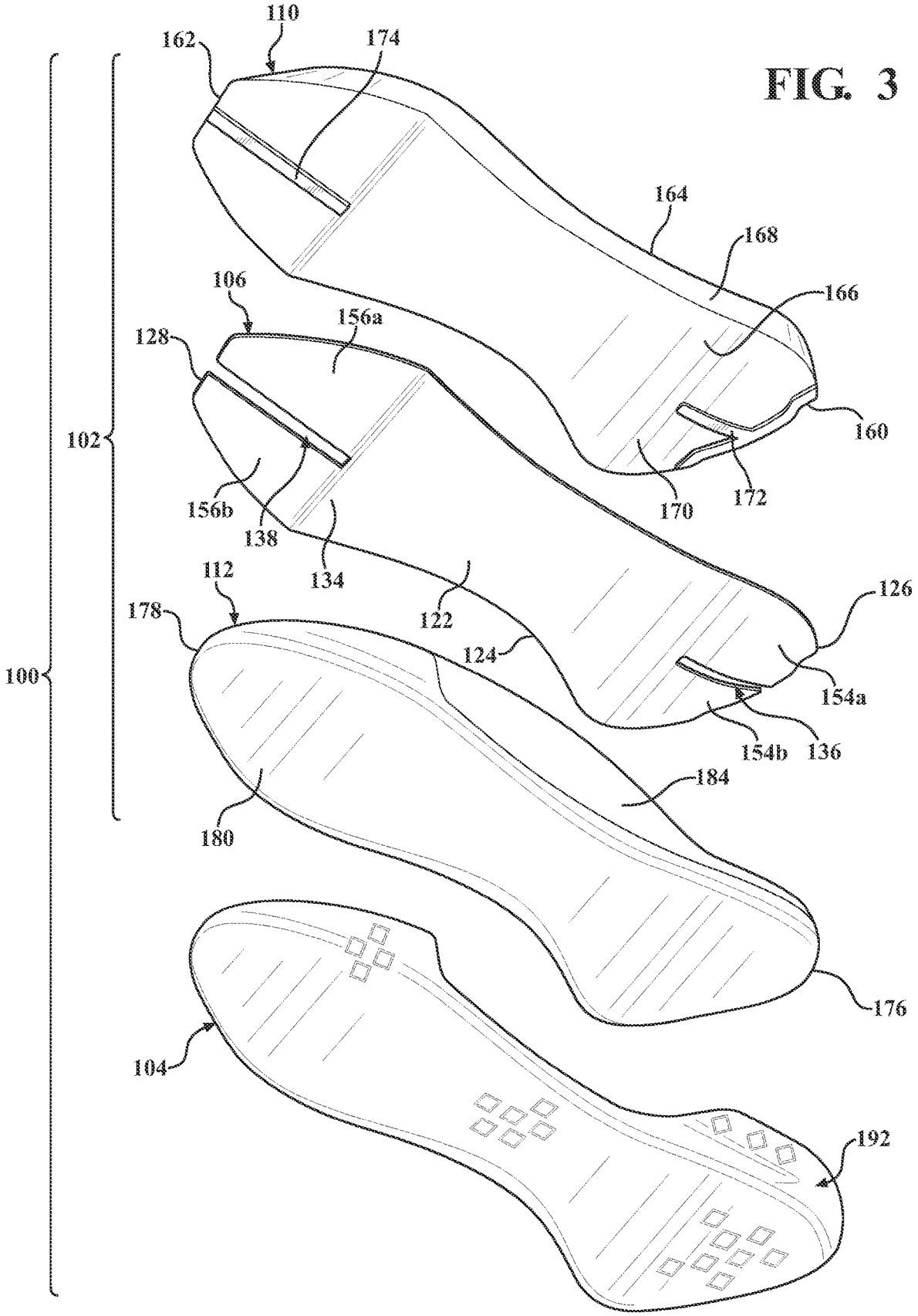
FIG. 3 is a bottom-rear exploded perspective view of the sole structure of FIG. 1.

As shown in FIGS. 2 and 3, the upper cushioning member 110 extends from a first end 160 at the anterior end 12 to a second end 162 at the posterior end 14. The upper cushioning member 110 includes an outer side 164 that faces the upper 200 and defines a footbed of the sole structure 100, an inner side 166 formed on an opposite side than the outer side 164 and configured to interface with the top side 120 of the plate 106, and a peripheral side surface 168 extending between the outer side 164 and the inner side 166 and defining an upper portion of a peripheral side of the midsole 102.

As shown in FIG. 3, the inner side 166 of the upper cushioning member 110 includes an upper receptacle 170 configured to receive the top side 120 of the plate 106. An outer periphery upper receptacle 170 corresponds to the peripheral edge 124 and the channels 136, 138 of the plate 106 such that the top side 120 of the plate 106 mates with the upper receptacle 170. Here, the upper receptacle 170 may include a pair of upper ribs 172, 174 configured to mate with the channels 136, 138, respectively. For example, a first rib 172 extends from the first end 160 of the upper cushioning member 110 and is received within an upper portion of the first channel 136 (FIG. 6) while a second rib 174 extends from the second end 162 of the upper cushioning member 110 and is received within an upper portion of the second channel 138 (FIG. 8). As discussed above, the upper receptacle 170 may extend through at least one of the lateral side 18 and the medial side 16 of the upper cushioning member 110 such that the peripheral edge 124 of the plate 106 is exposed along the outer periphery of the midsole 102.

Referring still to FIGS. 2 and 3, the lower cushioning member 112 extends from a first end 176 at the anterior end 12 to a second end 178 at the posterior end 14. The lower cushioning member 112 includes an outer side 180 that faces the outsole 104 and defines a profile of a ground-engaging surface of the sole structure 100, an inner side 182 formed on an opposite side than the outer side 180 and configured to interface with the bottom side 122 of the plate 106, and a peripheral side surface 184 extending between the outer side 180 and the inner side 182 and defining a lower portion of a peripheral side of the midsole 102. As best shown in FIG. 5, the outer side 180 of the lower cushioning member 110 is substantially convex and defines a first radius of curvature in the forefoot region 20, a second radius of curvature in the mid-foot region 22 that is tangent with and greater than the first radius of curvature, and a third radius of curvature in the heel region 24 that is tangent with the second radius of curvature and less than the first radius of curvature and the second radius of curvature. Accordingly, the outer side 180 provides transitional contact with the ground surface along the length of the sole structure 100 during a stance phase of a gait cycle.

As shown in FIG. 2, the inner side 182 of the lower cushioning member 112 includes a lower receptacle 186 configured to receive the bottom side 122 of the plate 106. An outer periphery of the lower receptacle 186 corresponds to the peripheral edge 124 and the channels 136, 138 of the plate 106 such that the bottom side 122 of the plate 106 mates with the lower receptacle 186. Here, the lower receptacle 186 may include a pair of lower ribs 188, 190 configured to mate with the channels 136, 138, respectively. For example, a first rib 188 extends from the first end 176 of the lower cushioning member 112 and is received within a lower portion of the first channel 136 (FIG. 6) while a second rib 190 extends from the second end 178 of the lower cushioning member 112 and is received within a lower portion of the second channel 138. Accordingly, the upper ribs 172, 174 and the lower ribs 188, 190 cooperate to fill the respective channels 136, 138 and to maintain alignment between the ends of the cushioning members 110, 112 and the ends of the plate 106. Further, the upper ribs 172, 174 are in contact with the lower ribs 188, 190, respectively, within the channels 136, 138 and, further, may be bonded or otherwise attached to one another at an interface between the upper ribs 172, 174 and the lower ribs 188, 190.

As described above, the cushioning members 110, 112 include a resilient polymeric material, such as foam or rubber, to impart properties of cushioning, responsiveness, and energy distribution to the foot of the wearer. In some examples, the upper cushioning member 110 may be formed of a first foam material and the lower cushioning member 112 is formed of a second foam material. For example, the upper cushioning member 110 may be formed of foam materials providing greater cushioning and impact distribution, while the lower cushioning member 110 is formed of a foam material having a greater stiffness, or vice versa.

Example resilient polymeric materials for the cushioning members 110, 112 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The outsole 104 of the sole structure 100 is formed of a resilient polymeric material configured to provide traction and abrasion resistance. As shown, the outsole 104 is formed as a unitary body that encapsulates a lower portion of the midsole 102. Thus, the outsole 104 completely covers the outer side 180 of the lower cushioning member 112 and extends at least partially upwardly around the peripheral side surface 184 of the lower cushioning member 112. The outsole 104 may further include a toe cap 192 extending over the peripheral side surface 168 of the upper cushioning member 110 and onto the upper 200 in the forefoot region 20. Accordingly, the outsole 104 provides a resilient protective shell along the bottom of the sole structure 100 and around the anterior end 12 of the upper 200. The outsole 104 may include a plurality of traction elements 194 extending along the bottom and around the toe cap 192 to provide improved grip during flat and inclined movements.

The sole structure 100 of the present disclosure includes several features that, alone and in combination, provide the sole structure 100 with improved performance—particularly in all-terrain environments such as hiking trails. For instance, the full-length plate 106 of the sole structure 100 provides a longitudinal stiffness along the length of the foot, which improves gait efficiency by maximizing stability and minimizing energy loss. Forming the plate 106 with the contoured body 130 accommodates the natural curvature of the foot, while the straight tail 132 provides stability along the posterior side of the calcaneus bone. Including the channels 136, 138 at one or both ends 126, 128 of the plate 106 allows the plate 106 to maintain longitudinal stability and performance while simultaneously allowing some torsional compliance along uneven terrain or during side-to-side movements. The plate 106 is encapsulated within the cushioning element 108, which provides impact dissipation and further accommodate uneven terrain. The outsole 104 is formed as a unitary structure that encapsulates the lower portion of the sole structure 100 to provide improved resistance to abrasions, punctures, and moisture while also maximizing traction.

The following Clauses provide an exemplary configuration for a sole structure for an article of footwear described above.

Clause 1. A sole structure for an article of footwear, the sole structure comprising a plate extending from a first end disposed at an anterior end of the sole structure to a second end disposed at a posterior end of the sole structure, the plate including a first channel formed in the first end and extending in a first direction toward the second end and a second channel formed in the second end and extending in a second direction toward the first end.

Clause 2. The sole structure of Clause 1, wherein the first channel and the second channel are both elongate.

Clause 3. The sole structure of any of the preceding Clauses, wherein the first channel and the second channel include the same shape.

Clause 4. The sole structure of any of the preceding Clauses, wherein the first channel extends at a first oblique angle relative to a longitudinal axis of the plate and the second channel extends at a second oblique angle relative to the longitudinal axis of the plate.

Clause 5. The sole structure of Clause 4, wherein a longitudinal axis of the first channel is convergent with a longitudinal axis of the second channel.

Clause 6. The sole structure of any of the preceding Clauses, wherein the plate includes a ramped portion extending from a heel region of the plate to the posterior end and extending in a direction away from a ground contacting surface of the sole structure, the second channel being formed in the ramped portion.

Clause 7. The sole structure of any of the preceding Clauses, wherein the first channel is longer than the second channel.

Clause 8. The sole structure of any of the preceding Clauses, wherein at least one of the first channel and the second channel includes a parallelogram shape.

Clause 9. The sole structure of any of the preceding Clauses, further comprising a midsole and an outsole, the plate being disposed between the midsole and the outsole and having a greater hardness than the midsole.

Clause 10. An article of footwear incorporating the plate of any of the preceding Clauses.

Clause 11. A plate for an article of footwear, the plate comprising: a main body including a first portion having an arcuate shape and a planar second portion extending in a first plane at an oblique angle from the first portion; a first channel extending from a first end of the main body, along the first portion, and in a direction toward the second portion; and a second channel extending from a second end of the main body, along the second portion, and in a direction toward the first portion.

Clause 12. The plate of Clause 11, wherein the first channel extends from the first end to a terminal end of the first channel along a first longitudinal axis.

Clause 13. The plate of Clause 12, wherein the first longitudinal axis is convergent with a longitudinal axis of the plate.

Clause 14. The plate of Clause 12, wherein the first portion includes a taper extending from the first portion and terminating at the terminal end of the first channel.

Clause 15. The plate of Clause 14, wherein the taper is aligned with the first channel and includes a similar width as the first channel, the width being measured in a direction substantially transverse to a longitudinal axis of the plate.

Clause 16. The plate of any of the preceding Clauses, wherein the second channel extends from the second end to a terminal end of the second channel along a second longitudinal axis.

Clause 17. The plate of Clause 16, wherein the second longitudinal axis is divergent from a longitudinal axis of the plate.

Clause 18. The plate of Clause 16, wherein the second portion includes a taper extending from the first portion and terminating at the terminal end of the second channel.

Clause 19. The plate of Clause 18, wherein the taper is aligned with the second channel and includes a similar width as the second channel, the width being measured in a direction substantially transverse to a longitudinal axis of the plate.

Clause 20. The plate of any of the preceding Clauses, wherein the first channel is longer than the second channel.

Clause 21. The plate of any of the preceding Clauses, wherein at least one of the first channel and the second channel includes a polygonal shape.

Clause 22. The plate of any of the preceding Clauses, wherein the first channel and the second channel are both elongate.

Clause 23. The plate of any of the preceding Clauses, wherein the first channel and the second channel include the same shape.

Clause 24. The plate of any of the preceding Clauses, wherein the first channel separates the first end of the plate into a first pair of tabs.

Clause 25. The plate of Clause 24, wherein the second channel separates the second end of the plate into a second pair of tabs.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising: a plate extending from a first end disposed at an anterior end of the sole structure to a second end disposed at a posterior end of the sole structure, the plate including a first channel formed in the first end and extending in a first direction toward the second end and a second channel formed in the second end and extending in a second direction toward the first end, wherein the plate includes only two channels and wherein an outer perimeter of both of the first channel and the second channel includes a parallelogram shape.

2. The sole structure of claim 1, wherein the first channel and the second channel are both elongate.

3. The sole structure of claim 1, wherein the first channel extends at a first oblique angle relative to a longitudinal axis of the plate and the second channel extends at a second oblique angle relative to the longitudinal axis of the plate.

4. The sole structure of claim 3, wherein a longitudinal axis of the first channel is convergent with a longitudinal axis of the second channel.

5. The sole structure of claim 1, wherein the plate includes a ramped portion extending from a heel region of the plate to the posterior end and extending in a direction away from a ground contacting surface of the sole structure, the second channel being formed in the ramped portion.

6. The sole structure of claim 1, wherein the first channel and the second channel include the same shape.

7. The sole structure of claim 1, further comprising a midsole and an outsole, the plate being disposed between the midsole and the outsole and having a greater hardness than the midsole.

8. An article of footwear incorporating the plate of claim 1.

9. The sole structure of claim 1, wherein the first end includes only one channel.

10. A plate for an article of footwear, the plate comprising:

a main body including a first portion having an arcuate shape and a substantially planar second portion extending in a first plane at an oblique angle from the first portion;

a first channel extending from a first end of the main body, along the first portion, to a terminal end of the first channel along a first longitudinal axis and separating the first end of the main body into a tab and a second tab, wherein the first and second tabs extend a substantially equal distance from the first end of the main body to the terminal end of the first channel; and a second channel extending from a second end of the main body, along the second portion, to a terminal end of the second channel along a second longitudinal axis and separating the second end of the main body into a third tab and a fourth tab, wherein the third and fourth tabs extend a substantially equal distance from the second end of the main body to the terminal end of the second channel.

11. The plate of claim 10, wherein the first portion includes a taper extending from the first portion and terminating at the terminal end of the first channel.

12. The plate of claim 11, wherein the taper is aligned with the first channel and includes a substantially equal width as the first channel, the width being measured in a direction substantially transverse to a longitudinal axis of the plate.

13. The plate of claim 10, wherein the second portion includes a taper extending from the first portion and terminating at the terminal end of the second channel.

14. The plate of claim 13, wherein the taper is aligned with the second channel and includes a substantially equal width as the second channel, the width being measured in a direction substantially transverse to a longitudinal axis of the plate.

15. The sole structure of claim 1, wherein the first channel terminates at a metatarsophalangeal axis of the plate.

16. The plate of claim 10, wherein the first portion includes a metatarsophalangeal axis, and wherein terminal end of the first channel is located at the metatarsophalangeal axis.

17. The plate of claim 10, wherein the second portion includes a heel region, and wherein the terminal end of the second channel is located at a joint of the heel region.

18. The plate of claim 10, wherein the main body includes a first taper extending from the first portion and terminating at the terminal end of the first channel and a second taper extending from the first portion and terminating at the terminal end of the second channel.

19. A plate for an article of footwear, the plate comprising:

a main body including a first portion having an arcuate shape and a substantially planar second portion extending in a first plane at an oblique angle from the first portion;

a first channel of constant width extending from a first end of the main body, along the first portion, to a terminal end of the first channel along a first longitudinal axis, wherein the first portion includes a first taper, of a width substantially equal to the constant width of the first channel, extending from the first portion and terminating at the terminal end of the first channel; and a second channel of constant width extending from a second end of the main body, along the second portion, to a terminal end of the second channel along a second longitudinal axis, wherein the second portion includes a second taper, of a width substantially equal to the constant width of the second channel, extending from the second portion and terminating at the terminal end of the second channel.

* * * * *